US006227794B1

(12) United States Patent
Wojtyczka et al.

(10) Patent No.: US 6,227,794 B1
(45) Date of Patent: May 8, 2001

(54) FAN CASE WITH FLEXIBLE CONICAL RING

(75) Inventors: Czeslaw Wojtyczka, Brampton; Camil Rabinovici, Willowdale, both of (CA)

(73) Assignee: Pratt & Whitney Canada Corp., Longueil (CA)

( * ) Notice: Subject to any disclaimer, the term of this patent is extended or adjusted under 35 U.S.C. 154(b) by 0 days.

(21) Appl. No.: 09/466,001

(22) Filed: Dec. 16, 1999

(51) Int. Cl.[7] ..... F01D 21/00; F01D 25/24
(52) U.S. Cl. ..... 415/9; 415/173.4; 415/200
(58) Field of Search ..... 415/9, 173.4, 196, 415/197, 200

(56) References Cited

U.S. PATENT DOCUMENTS 4,490,092 * 12/1984 Premont ..... 415/9
5,388,959 * 2/1995 Forrester et al. ..... 415/173.4
5,485,723 * 1/1996 McCoy et al. ..... 415/9
5,516,257 * 5/1996 Kasprow et al. ..... 415/9
6,113,347 * 9/2000 Forrester ..... 415/9

* cited by examiner

*Primary Examiner*—Christopher Verdier
(74) *Attorney, Agent, or Firm*—Jeffrey W. Astle

(57) ABSTRACT

There is provided a hardwall fan case for encasing a forward fan in a gas turbine engine. The fan case has a stiff annular shell spaced radially outward from the tips of the fan blades and a flexible ring which is an integral structural part of the shell. The flexible ring has a frusto-conical shape with a lip adjacent to the blade trailing edge. The ring extends axially rearwardly from the fixed root to the free inner edge forming a cantilevering resilient ring. A hollow cavity defined between an inner surface of the shell and an outer surface of the flexible ring provides clearance for the flexible ring to deform radially outwardly on impact with a released blade, or to elastically flex on contact with the trailing edge blade tip during bird strike events.

14 Claims, 2 Drawing Sheets

FAN CASE WITH FLEXIBLE CONICAL RING

TECHNICAL FIELD

The invention relates to a fan case for a gas turbine engine with a hard wall annular shell and a flexible ring mounted to the inner surface of the shell with a trailing edge lip immediately adjacent to the blade tips.

BACKGROUND OF THE ART

The fan case of a turbofan engine directs the axial flow of air in conjunction with the fan during normal engine operation, prevents released fan blades from escaping radially or forwardly and restrains the low pressure shaft radial deflection and blade tips during bird strike events.

The fan is conventionally used in a turbo-fan engine to force a primary air stream through the compressor and turbines of the engine and to force a secondary airflow through an annular radially outward bypass duct. It is essential that the clearance between the rotating fan blades and the internal surface of the fan case be kept within an acceptable range to optimise the fan efficiency. To maintain engine operation and ensure safety, the fan case must also retain or rearwardly deflect released blades, and withstand the effect of bird impact on the blades.

The internal air path surfaces of the fan case are lined with a compressible and a soft abradable material sprayed on the internal fan case surface immediately adjacent the blade tips. During the operation of the engine and rotation of the newly manufactured fan, some of the soft abradable material is removed on contact with the relatively hard tip of the rotating fan blade. A typical thickness for the abradable layer of material is in the order of 0.070 inches. When assembled the tip clearance is in the order of 0.005 to 0.030 inches. During the initial high-speed rotation of the fan, the fan blades stretch elastically under the load of centrifugal force in the order of 0.020 to 0.040 inches. Depending on the heat generated during operation, the blades may thermally expand as well. Due to the dynamic stretching and thermal expansion of the metallic blades, the abradable material is removed on contact with the fan blade tip. Each fan will have its own manufacturing tolerances and the actual degree of running clearance required and stretching of blades will vary a certain amount between different fans when manufactured. The provision of abradable material allows for close tolerance and minimizing of clearance between the fan blade tip and the annular internal air path surface of the fan case.

In the case of small turbofan engines in particular, the clearance between fan blade tips and the fan case internal surface is often of a critical nature. Due to a high aerodynamic loading of the blades, the fan stage stall margin is very sensitive to the tip clearance. Abnormal changes in tip clearance can adversely affect the engine thrust and surge margin.

The fan case and fan must also ensure safe operation of the turbofan engine during two critical conditions; firstly, on the ingestion of birds which strike the fan blades; and secondly, in the event of breakage of a fan blade. These two conditions are known generally as a "bird strike event" and a "blade off event" respectively.

In the prior art, a bird striking the fan generally results in an increase of tip clearance between the fan blade tips and the internal surface of the fan case. The soft abradable material bonded to the interior surface of the fan case is removed together with the compressible material radially outward of the abradable material when the bird strike condition is encountered as follows. When an outboard bird is ingested into the forward fan area, the fan blades cut the bird into fragments and propel the fragments tangentially and axially rearwardly. Depending on the configuration of the flow splitter downstream of the fan, a proportion of the bird fragments are expelled axially through the outward annular by-pass duct, and a portion of bird fragments are ingested into the engine core through the compressor and turbines.

Of particular interest to the present invention is the effect of a bird strike and resulting interaction of the fan blades with the fan case. The fan blades are deformed due to the impact and unbalanced loading. The axial and radial unbalanced loads are transmitted to the low power compressor shaft, the supporting structure and the engine mounts. The fan on the rotating shaft will deflect radially outwardly and cut deeply into the compressible material and abradable material which lines the interior surface of the fan case.

Prior art fan cases for small engines are lined with approximately 0.100 to 0.300 inches of abradable material applied on the interior surface of an approximately 0.300 to 0.500 inch thick layer of compressible material. Twisted and deflected fan blades severely cut into these materials and lead to excessive fan tip clearances.

On a medium bird strike event, regulations require that the engine thrust decreases to no less than 75% of maximum engine thrust within 20 minutes after the bird strike. A number of engine components may be damaged due to the bird strike; however, the cumulative effect of various types of damage cannot reduce the total engine thrust by more than 25%.

Bird strikes may deform the fan blades, damage the engine core, and the compressor blades in addition to increasing the fan blade tip clearance dramatically. It has been found through experiment that excessive fan blade tip clearance can result in 7 to 9% of the thrust loss alone. Considering that regulations require no more than 25% engine thrust loss, it can be seen that excessive fan blade tip clearance after a bird strike is a significant cause of engine thrust loss.

Small diameter fans are extremely sensitive to excessive tip clearance and excessive tip clearance can lead to dangerous stall or surge conditions on encountering "bird strike" events.

The prior art has provided means to limit tip clearance problems on bird strike by providing a hardwall fan case which comprises a stiff fan case shell approximately parallel to the fan blade tips lined with layers of compressible and abradable materials to compensate for manufacturing tolerances and stretch of the blades in operation. Due to excessive movement of the fan blades during a bird strike event, the fan blade tip might wear away the abradable and compressible materials and directly contact the hardwall of the fan case. The fan case is lined with a layer of abradable and compressible materials, since there is a concern that tight clearance during running of the engine will result in dynamic coincidence when the rotor blades rub against the hardwall containment fan case before the rotor stabilizes around its own centre of rotation. The abradable material is therefore used to line a hardwall fan case to give sufficient clearance to stabilize the rotor around its own centre of rotation, without damaging the compressible material during normal running conditions.

A significant disadvantage of a hardwall fan case however, is encountered when a fan blade breaks off in the "blade off" condition. Standard tests are conducted on engine designs wherein a fan blade is released at the maximum permissible engine speed, (known as the red line condition). The fan case structure provides important protection for aircraft and passengers since the rapid rotation of the fan propels the released fan blade tangentially at high speeds. The fan case is provided to contain any released fan blade within the engine itself, or to eject released blade axially rearwardly through the by-pass duct.

A hardwall fan case has a disadvantage resulting from the shape of the internal air path surface. The air path surface generally converges radially inwardly as the air taken into the engine simultaneously increases in pressure and decreases in volume. The internal air path surfaces are tapered radially inwardly such that a released fan blade will bounce off the hardwall fan case and be redirected forwardly. Further catastrophic engine or fuselage damage may occur as a result. The thin sheet metal nacelle in the front of the engine will not contain the released blade propelled with high energy. As a result, regulations require that any released fan blade be directed axially rearwardly to avoid further damage, or be contained within the fan case itself. Deflection of released fan blades forwardly, as well radial expulsion through the fan case itself are very dangerous and unacceptable.

As a result, it has been common to provide a relatively heavy fan case shell, which is lined with compressible material, coated with abradable material. The compressible material acts to absorb the impact of the high velocity released fan blade. However, providing the required thick layer of compressible material shaping the air path surface leads to unacceptable large fan tip clearances during a bird strike event as mentioned above. In the case of relatively large engines however, excessive fan tip clearance is less critical than in small engines.

Therefore, in the prior art there is a conflict between two competing conditions that must be accommodated by fan cases and fan blades. In the case of a medium bird strike, it is preferred that a hardwall fan case be provided to maintain the fan tip clearance within acceptable limits. However, in the case of fan blade breakage, it is preferred to line the fan case with a relatively soft compressible material that can absorb the impact with released fan blade and has a stiff shell surface that can deflect any released fan blade rearwardly.

In the case of a hardwall fan case, the shape of the air pathway tapers inwardly as it progresses rearwardly through the engine and the pressure of air increases with corresponding decrease in volume. By providing a hardwall fan case which follows the air path shape. Generally a released fan blade will be deflected forwardly and impose the risk of unacceptable accidental damage. Released fan blades must be retained within the fan case itself, or be ejected axially rearwardly.

Therefore, it is desirable to provide a fan case structure which can maintain fan tip clearance within acceptable limits after a bird strike event while simultaneously ensuring that any released fan blades are directed axially rearwardly, or retained within the fan case structure itself.

It is also desirable to provide such a fan case structure that will use existing materials and technology without requiring significant rework or re-certification of existing designs.

Further objects of the invention will be apparent from review of the drawings and description of the invention below.

DISCLOSURE OF THE INVENTION

The invention is a hardwall fan case for encasing a forward fan in a gas turbine engine. Conventionally fans have a circumferentially spaced apart array of fan blades each blade having: a centre of gravity; a leading edge; a trailing edge; and a blade tip. The fan case has a stiff annular shell spaced radially outward from the tips of the fan blades with a flexible ring mounted to the inner surface of the shell. The flexible ring has a frusto-conical shape with a trailing edge lip immediately adjacent the blade tips.

The flexible ring serves during a medium bird strike event to: (1) flex on contact with the trailing edge blade tip and allow free transient blade deformation; (2) flexibly restrain and control the fan blade trailing edge tip clearance; (3) reduce fan blade tip damage; (4) reduce the risk of fan stalling and surge by reducing removal of abradable material thus maintaining tip clearance within safe limits; and (5) reduce the risk of coincidence by stiffening the fan case in the rotor section.

The flexible ring also serves during a blade off event to (6) flex under impact, absorbing the force of impact to protect the shell and contain the released blade, and plastically deform or elastically rebound to direct the released fan blade rearwardly.

The flexible ring has a root circumferentially mounted to the inner surface of the shell, and an inner edge adjacent the trailing edges of the fan blade tips. The ring extends axially rearwardly from the fixed root to the free inner edge forming a cantilevering resilient ring. A hollow cavity defined between an inner surface of the shell and an outer surface of the flexible ring provides clearance for the flexible ring to deform radially outwardly on impact with a released blade, or to elastically flex on contact with the trailing edge blade tip during bird strike events.

Preferably the inner conical surface of the flexible ring and an outer conical surface of the leading section of the shell define a circumferential skewed channel that enhances airflow stability through the fan.

The leading section of the shell preferably includes a rigid bumper with a rigid rear edge disposed an offset distance forwardly of the fan blade centres of gravity. When a released blade is propelled radially under centrifugal force, the released fan blade strikes the bumper edge. The released blade is rotated about the bumper edge under a force moment equal to the centrifugal force multiplied by the offset distance. As a result, the released blade is redirected from a radial trajectory and rotated rearwardly for rearward ejection axially through the gaspath, or alternatively for retention within the compressible material housed in the trailing section of the shell.

The leading section, the trailing lip of the flexible ring and the trailing compressible material are preferably covered with a layer of abradable material that allows the rotating fan blades during normal operation to achieve close tip tolerance with the hardwall fan case.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
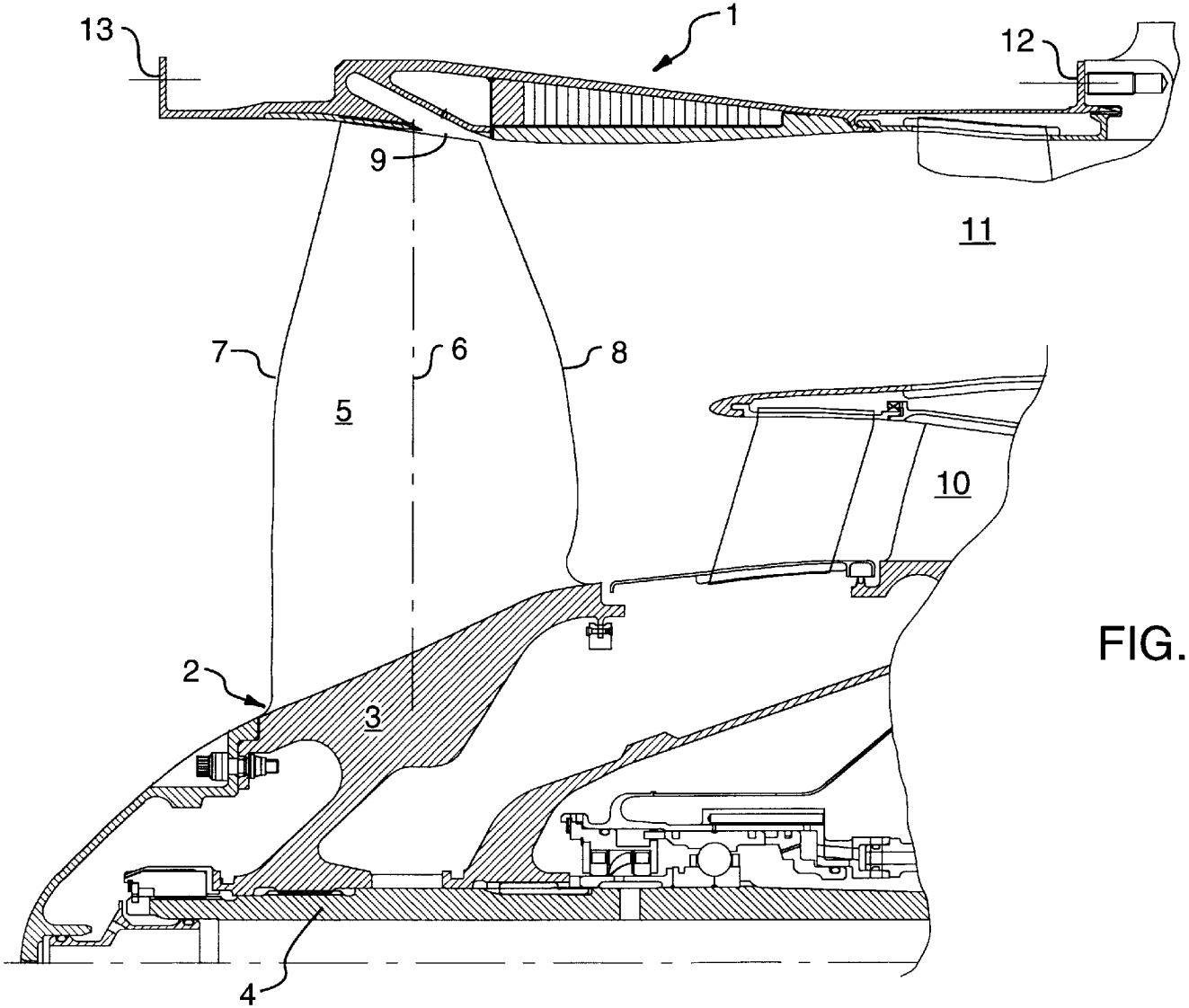
FIG. 1 is a partial axial cross-sectional view showing one-half of a fan rotor with a blade and the fan case according to the invention disposed radially outwardly from the fan blades.

FIG. 1 illustrates the forward section of a gas turbine engine with fan rotor in axial cross-sectional view. The fan case 1 encases the radial periphery of a forward fan 2. The fan 2 is made up of a central fan hub 3 mounted to a shaft 4 with a circumferentially spaced apart array of fan blades 5; each blade having a centre of gravity 6, a leading edge 7, a trailing edge 8 and a blade tip 9. The fan 2 drives airflow rearwardly into the core duct 10 and into the bypass duct 11. The hardwall fan case 1 is mounted to the engine structure with a rear flange 12 and is connected to the aircraft nacelle with forward flange 13.

Figure 2:
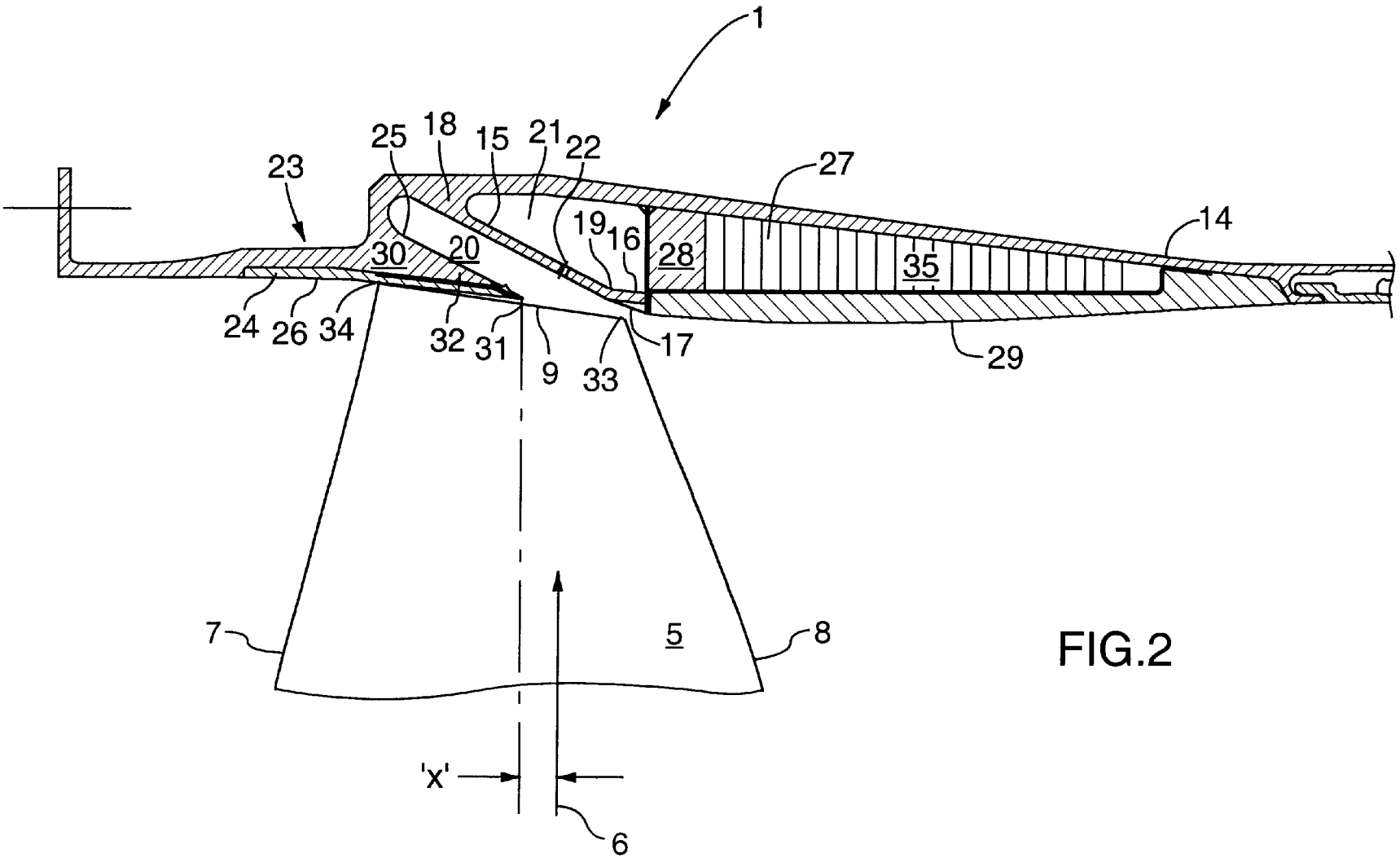
FIG. 2 is a detailed partial axially sectional view showing the fan case with stiff metal fan case shell, frusto-conical flexible ring, hollow cavity outward of the ring, compressible material and abradable material defining the annular internal air path surface of the fan case and showing the blade tip area in detail.

Turning to FIG. 2, the fan case 1 is constructed of a stiff annular shell 14 spaced radially outward from the tips 9 of the fan blades 5. The shell is machined out of a steel forging.

The fan case also includes a flexible ring 15, which in the embodiment illustrated is a frusto-conical shape with a trailing edge lip 16 having an inner surface substantially parallel to the fan blade tips 9. The trailing edge lip 16 includes a trailing edge layer 17 of abradable material to reduce, wear and maintain the blade tip gap at the trailing edge 8.

The root 18 of the flexible ring 15 is connected to the inner surface of the shell 14. The inner edge 19 with trailing edge lip 16 is adjacent the trailing edges 8 of the fan blade tips 9.

As will be explained in detail below, the flexible ring 15 during a bird strike event comes into physical contact with the blade tips 9 adjacent the trailing edge 8 and flexibly guides the blade tip 9 to prevent creation of a large tip clearance and reduce fan blade tip damage. In addition, the flexible ring 15 serves during a blade off event to flex under impact from a released blade to direct the released blade rearwardly.

In order to flex on contact with the blade 5, the flexible ring 15 is fixed at the root 18 and it is free to move on contact with the blade 5 at the inner edge 19. The flexible ring 15 therefore represents a structural cantilever and extends axially rearwardly from the root 18 to the inner edge 19. In the embodiment illustrated an inwardly open circumferential channel 20 is provided to reduce airflow turbulence in the blade tip 9 area. The specific shape of the channel 20 is dictated by aerodynamic concerns. As a result, the shape of the inner surface of the flexible ring 15 can be adapted to any shape of channel 20 desired or alternatively the channel 20 may be eliminated entirely by filling it with frangible material as desired. However, in the embodiment illustrated, the flexible ring 15 is shown as preferably a frusto-conical shape extending radially inwardly from the root 18 to the inner edge 19.

A hollow air-filled cavity 21 is defined between an inner surface of the shell 14, an outer surface of the flexible ring 15, and the compressible honeycomb liner 35. The flexible ring 15 includes air vents 22 between the cavity 21 and the inner surface of the flexible ring 15. The vents 22 allow free passage of air between the cavity 21 and the channel 20. When the flexible ring 15 is deflected, the size of cavity 21 accordingly decreases and the venting of air trapped within the cavity 21 is necessary to permit the flexible ring 15 to freely deform and/or elastically flex.

The shell 14 also includes a leading section 23 with an inner surface 24 substantially parallel to the fan blade tip 9 in the forward portion of the blades 5. An outer surface 25 of the leading section is spaced a distance from the inner surface of the flexible ring 15 thereby defining the inwardly open circumferential channel 20. The inner surface 24 of the leading section 23 includes a leading edge layer 26 of abradable material. Abradable material 26 has a thickness of about 0.100 inches to accommodate a tip growth of 0.040 inches for normal engine operation and an additional 0.030 inches to accommodate the free fan blade growth under a medium bird strike condition. Depending on the engine configuration the normal range for the thickness of abradable material is about 0.050 to 0.100 inches.

The cavity 21 also includes a trailing section 27 rearward of the inner edge 19 of the flexible ring 15. As illustrated in FIG. 2, the trailing section includes compressible honeycomb material 28, radial compressible honeycomb material 35 and on its inner surface includes a layer of abradable material 29. The combined thickness of the honeycomb compressible materials 28, 35 and trailing section abradable material 29 is in the range of 0.250 and 0.500 inches. This thickness accommodates the impact of a released blade and preferably enables the released blade to become embedded within the trailing section 27 held within the compressible material 28, 35.

In a blade off or released blade event, the released blade 5 will be propelled rapidly in a radial direction due to the centrifugal force which is illustrated in FIG. 2 as a vector arrow through the centre of gravity 6 of the blade 5. As mentioned above, it is necessary to provide a fan case structure 1 which redirects the released blades from a radial direction to a rearward direction. In order to perform this function, the leading section 23 includes a rigid bumper 30 with a rigid rear edge 31 offset a distance X forwardly of the fan blade centre of gravity 6. In the embodiment illustrated to provide a skewed channel 20, the bumper edge 30 is disposed on a rearwardly extending bumper flange 32.

Therefore, during a blade off event the following sequence of events occurs. The released fan blade is tangentially expelled under centrifugal force indicated by the arrow in FIG. 2. On impact with the bumper 30, the force moment created by the offset distance X times the centrifugal force vector will rotate the released blade rearwardly about the rear edge 31. As drawn in FIG. 2 the released blade will rotate in a counter clockwise direction. Further rotation of the released blade brings the trailing edge tip 33 into contact with the flexible ring 15. Friction between the trailing edge tip 33 and the flexible ring 15 combined with the rotational motion of the released blade will twist the released blade in addition to the rotation mentioned above. As a result of these forces and motions, the released blade will impact with the inner edge 19, trailing edge lip 16 or other rearward portions of the flexible ring 15. The flexible ring 15 will plastically deform under impact with the released fan blade. A significant portion of the impact force will be absorbed by the flexible ring 15. The flexible ring 15 therefore serves as a deflector and as an impact absorber thus reducing the impact of the released blade on the inner surface of the shell 14.

The flexible ring 15 also serves to improve engine performance during a medium bird strike event where blades 5 are deformed as a result of impact of the bird ingested into the engine but otherwise are not detached from the fan 2.

As shown in FIG. 2, the blade tip clearance from the leading edge tip 34 to the rear edge 31 of the bumper 30 is maintained by the close contact between the blade tip 9 and the leading edge layer of abradable material 26. In the blade tip area between the rear edge 31 of the bumper and the trailing edge tip 33, the channel 20 is provided to reduce airflow turbulence. The efficiency of the channel 20 is very sensitive to the geometry of the channel 20. Maintaining close blade tip clearance is necessary in the leading edge portion of the blade tip 9 as well as at the trailing edge.

Additionally, during a medium bird strike event the blade 5 is severely deformed and flexes. To prevent severe damage to the blade tips however and reduce the risk of fan stalling after a bird strike, event, the inner edge 19 of the flexible ring 15 with a trailing edge abradable layer 17 is provided adjacent the trailing edge tip 33 for the following reasons. During a bird strike event, the trailing edge blade tip 33 twists relative to its radial axis. In the prior art where abradable material is provided in this area, the trailing edge tip 33 has a tendency to gouge deeply into the abradable material.

In contrast, the present invention provides the flexible ring 15 to flex on contact between the trailing edge lip 16 and the trailing edge tip 33. The blade is allowed to undergo free transient blade deformation and the blade trailing edge tip 33 is not severely damaged due to the physical contact with the flexible trailing edge lip 16. The flexible ring 15 elastically deflects during high transient load conditions after a medium bird strike. When the transient loads are stabilised, the flexible ring 15 springs back to its original position. As a result, the thrust loss due to high fan blade tip clearance is significantly reduced from typically 7% loss to 2% loss. The reduction in thrust loss is due to the minimal fan tip clearance increase compared to prior art configurations.

The flexible ring 15 also serves during a bird strike event to flexibly restrain and control the fan blade trailing edge tip clearance by physical contact between the trailing edge tip 33 and the flexible trailing edge lip 16. Therefore the two corners 34 and 33 of the blade tip 9 are both constrained and excessive material is not abraded from the leading edge layer 26 of abradable material nor is the fan blade tip 9 subjected to severe damage. As a result therefore, after a bird strike event the thickness of abradable material 26 is substantially maintained and the flexible ring 15, having deformed elastically, can rebound to its original configuration without damage to the trailing edge tip 33 or increasing the blade tip clearance at the trailing edge 8. Therefore the risk of fan stalling and surging is reduced since abradable material is not removed in excessive amounts and the tip clearance can be maintained within safe limits.

Although the above description relates to a specific preferred embodiment as presently contemplated by the inventors, it will be understood that the invention in its broad aspect includes mechanical and functional equivalents of the elements described.

We claim:

1. A hardwall fan case for encasing the radial periphery of a forward fan in a gas turbine engine, the fan including a circumferentially spaced apart array of fan blades, each blade having: a centre of gravity; a leading edge; a trailing edge; and a blade tip, the fan case comprising:

a stiff annular shell spaced radially outward from the tips of the fan blades:

a flexible ring having a root circumferentially mounted to an inner surface of the shell, and an inner edge adjacent the trailing edges of the fan blade tips, the ring extending axially rearwardly from the root to the inner edge; and a cavity defined between an inner surface of the shell and an outer surface of the flexible ring.

2. A hardwall fan case according to claim 1 wherein the flexible ring extends radially inwardly from the root to the inner edge.

3. A hardwall fan case according to claim 2 wherein the flexible ring is frusto-conical.

4. A hardwall fan case according to claim 2 wherein the inner edge of the flexible ring includes a trailing edge lip with an inner surface substantially parallel to the fan blade tips.

5. A hardwall fan case according to claim 4 wherein the inner surface of the trailing edge lip includes a trailing edge layer of abradable material.

6. A hardwall fan case according to claim 2 wherein the shell includes a leading section with an inner surface substantially parallel to the fan blade tips, and an outer surface spaced a distance from the inner surface of the flexible ring thereby defining an inwardly open circumferential channel.

7. A hardwall fan case according to claim 6 wherein the inner surface of the leading section includes a leading edge layer of abradable material.

8. A hardwall fan case according to claim 7 wherein the leading edge layer of abradable material has a thickness in the range of 0.050 to 0.100 inches.

9. A hardwall fan case according to claim 1 wherein the cavity includes a trailing section rearward of the inner edge of the flexible ring, and the trailing section includes compressible material.

10. A hardwall fan case according to claim 9 wherein an inner surface of the trailing section includes a layer of abradable material.

11. A hardwall fan case according to claim 10 wherein the compressible material and trailing section abradable layer have a combined thickness in the range of 0.250 to 0.500 inches.

12. A hardwall fan case according to claim 2 wherein the flexible ring includes vents between the cavity and the inner surface of the flexible ring.

13. A hardwall fan case according to claim 6 wherein the leading section includes a rigid bumper with a rigid rear edge disposed an offset distance forwardly of the fan blade centres of gravity.

14. A hardwall fan case according to claim 13 wherein the bumper edge is disposed on a rearwardly extending bumper flange.

* * * * *